US010329878B2

(12) United States Patent
Ringgenberg

(10) Patent No.: US 10,329,878 B2
(45) Date of Patent: Jun. 25, 2019

(54) MAINTAINING A DOWNHOLE VALVE IN AN OPEN POSITION

(71) Applicant: Halliburton Energy Services, Inc., Houston, TX (US)

(72) Inventor: Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 15/310,819

(22) PCT Filed: Jun. 17, 2014

(86) PCT No.: PCT/US2014/042759

§ 371 (c)(1),
(2) Date: Nov. 14, 2016

(87) PCT Pub. No.: WO2015/195098

PCT Pub. Date: Dec. 23, 2015

(65) Prior Publication Data

US 2017/0114611 A1 Apr. 27, 2017

(51) Int. Cl.

| | |
|---|---|
| ***E21B 34/10*** | (2006.01) |
| ***E21B 34/06*** | (2006.01) |
| *E21B 34/00* | (2006.01) |

(52) U.S. Cl.
CPC ..... *E21B 34/102* (2013.01); *E21B 34/063* (2013.01); *E21B 2034/002* (2013.01)

(58) Field of Classification Search
CPC ..... E21B 34/063; E21B 34/102; E21B 34/103
See application file for complete search history.

(56) References Cited

U.S. PATENT DOCUMENTS 3,970,147 A * 7/1976 Jessup ..... E21B 34/102 166/374
4,125,165 A 11/1978 Helmus
4,474,242 A * 10/1984 Upchurch ..... E21B 49/001 166/323

(Continued)

FOREIGN PATENT DOCUMENTS

| | | | |
|---|---|---|---|
| EP | 0861968 | A2 | 9/1998 |
| WO | 2011101344 | A2 | 8/2011 |
| WO | 2015195098 | A1 | 12/2015 |

*Primary Examiner* — Kipp C Wallace
(74) *Attorney, Agent, or Firm* — John W. Wustenberg; Parker Justiss, P.C.

(57) ABSTRACT

A downhole valve system includes a downhole valve positionable in a wellbore and a downhole valve actuator coupled to the downhole valve. An annulus is defined between the downhole valve and the wellbore. The downhole valve actuator includes a pressure chamber that encloses a pressurized fluid at a particular pressure and a breakable member. The downhole valve actuator is adjustable to a first position to close the downhole valve when the particular pressure is greater than an annulus pressure at a first pressure in the annulus, and the downhole valve actuator is adjustable to a second position to lock the downhole valve in an open position independent of the relative values of the particular pressure and the annulus pressure, with the annulus pressure set at a second pressure greater than the first pressure to break the breakable member.

18 Claims, 9 Drawing Sheets

(56) References Cited

U.S. PATENT DOCUMENTS

| | | | | |
|---|---|---|---|---|
| 4,667,743 | A * | 5/1987 | Ringgenberg | E21B 23/006 166/240 |
| 4,846,272 | A | 7/1989 | Leggett | |
| 4,903,775 | A * | 2/1990 | Manke | E21B 23/006 166/149 |
| 5,819,853 | A * | 10/1998 | Patel | E21B 34/063 166/373 |
| 7,303,020 | B2 * | 12/2007 | Bishop | E21B 23/00 166/319 |
| 2001/0023765 | A1 * | 9/2001 | Patel | E21B 21/10 166/375 |
| 2009/0301184 | A1 | 12/2009 | Irani et al. | |
| 2012/0018172 | A1 * | 1/2012 | Javed | E21B 34/14 166/382 |

* cited by examiner 400
102
450
124
420
450
404
102
406
450
416
450
414
102
408
450
418
450
422
450
450
450

500
102
450
124
420
450
404
102
416
450
406
450
414
102
408
450
418
450
422
450
450
450

MAINTAINING A DOWNHOLE VALVE IN AN OPEN POSITION

CROSS-REFERENCE TO RELATED APPLICATION

This application is the National Stage of, and therefore claims the benefit of, International Application No. PCT/US2014/042759 filed on Jun. 17, 2014, entitled "MAINTAINING A DOWNHOLE VALVE IN AN OPEN POSITION," which was published in English under International Publication Number WO 2015/195098 on Dec. 23, 2015. The above application is commonly assigned with this National Stage application and is incorporated herein by reference in its entirety.

TECHNICAL BACKGROUND

This disclosure relates to a downhole fluid valve actuator for downhole tools.

BACKGROUND

Valves in some downhole tools can be controlled via increasing or decreasing the pressure of the fluid in the annulus surrounding the tool. For example, a ball valve can be opened by increasing the pressure in the annulus above a certain reference pressure. In some cases, decreasing the annulus pressure below the reference pressure closes the ball valve. When the tool is removed from the wellbore, the annulus pressure in the vicinity of the tool decreases, and the valve closes. Any fluid remaining in the tool when the valve closes adds to the weight of the tool string. The additional weight of the remaining fluid can cause damaging strain on the tool string. Furthermore, the additional weight means that more work is required to remove the tool string from the wellbore.

DETAILED DESCRIPTION

The present disclosure relates to a downhole fluid valve actuator in a wellbore. The actuator is able to open a valve (e.g., a ball valve) in a tool string in response to an increase in pressure in the annulus surrounding the tool string. The actuator is also configured to keep the valve in the open position even as the tool string is removed from the well. In some implementations, the valve is configured to remain in the open position by increasing the annulus pressure above a reference pressure. For example, a rupture disk can be implemented such that rupturing the rupture disk with high applied annulus pressure disables the valve closing mechanism within the actuator. In another example, the valve closing mechanism can be disabled by shearing a shear pin via a high applied annulus pressure. In some implementations, the movement of a piston within the actuator is limited such that once a valve is opened it cannot be closed. In some implementations, the actuator is strained during tool removal such that the actuator mechanism is held in the open valve configuration.

Various implementations of a downhole valve system that includes a valve and a valve actuator according to the present disclosure may include none, one or some of the following features. The downhole valve system can reduce strain on the tool string by maintaining the valve in the open position during tool string removal. Some implementations allow the valve to be opened and closed repeatedly until a high annulus pressure is applied that disables the valve closing mechanism. As another example, the downhole valve system can reduce or eliminate pressure trapped between a valve and other downhole tools coupled to the valve system in a downhole string by maintaining the valve in the open position during tool string removal. Further, a downhole tool string that includes the downhole valve system can drain by maintaining the valve in the open position during tool string removal, so that fluid is not brought to a surface and exposed to working personnel.

Figure 1:
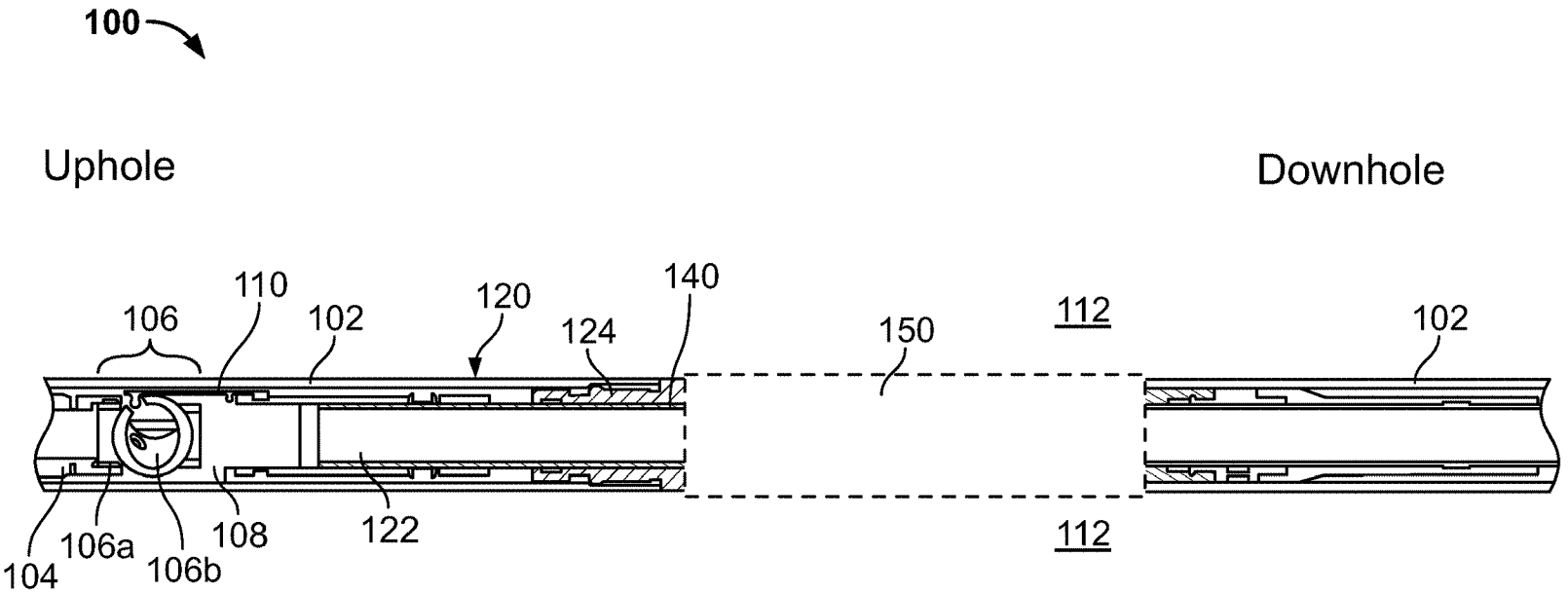
FIG. 1 illustrates a cross-section view of an example well system that includes a downhole valve system.

FIG. 1 illustrates a cross-section view of an example well system 100 that includes a downhole valve system 120. An annulus 112 between the downhole valve system 120 and the wellbore can contain a fluid such as well fluid. The illustrated well system 100 can be implemented in, for example, a downhole tubing and/or tool system that extends from a terranean surface, that is above sea-level (e.g., or otherwise not extending from a location that is under a body of water), or can be implemented in a well system located in an ocean-based environment or other environment that includes a body of water. Thus, reference to a terranean surface includes surface locations that are above, as well as below, a body of water (e.g., ocean, sea, lake, river, or otherwise).

The downhole valve system 120 includes a valve actuator 150 connected to a mandrel 140. The mandrel 140 is a tubular member that partly defines a bore 122 within the downhole valve system 120. The valve system 120 includes a housing 124 that is coupled to one or more operating cases 102. The housing 124 and/or the operating cases 102 may be coupled to the downhole valve actuator 150. The operating case 102 can at least in part encase and support a retainer 104, where the uphole side of the retainer 104 is mechanically coupled, directly or indirectly, to machinery or apparatus at the top of the wellbore or well system controlling the well system 100. The downhole side of the retainer 104 is mechanically coupled to the uphole side of a ball-and-seat valve 106, which includes a seat **106*a* in which a ball 106*b* is rotatably mounted. Rotation of the ball 106*b* between a first and second position within the seat 106*a* corresponds to the ball-and-seat valve 106 switching between a closed and an open position. As shown in FIG. 1, the ball-and-seat valve 106 is in a closed position. Although shown as a ball-and-seat valve 106, other types of valves may also be used without departing from the scope of the disclosure. For example, any downhole valve that can be actuated mechanically (e.g., by shifting a mandrel coupled to the valve) may be implemented in the present system 120**.

The downhole side of the ball-and-seat valve 106 is mechanically coupled to the uphole side of a ball cage 108. The ball cage 108 is configured to at least in part encase and support the ball-and-seat valve 106. Similarly, the operating case 102 can at least in part encase and support both the ball-and-seat valve 106 and the ball cage 108. An operating arm 110 has an uphole end proximate to the ball-and-seat valve 106 that is mechanically coupled to the ball 106*b*. The operating arm 110 is coupled to the mandrel 140.

The mandrel 140 can be actuated by a mechanism. For example, the mandrel 140 can be translated uphole or downhole by valve actuator 150. When the mandrel 140 is translated, the mandrel 140 shifts the operating arm 110. The shifting operating arm 110 rotates the ball 106*b* within the seat 106*a* between a first and second position, respectively switching the ball-and-seat valve 106 between the closed and the open positions. In some implementations, the mandrel 140 is translated downhole to open the ball-and-seat valve 106 and translated uphole to close the ball-and-seat valve 106. When the ball-and-seat valve 106 is in an open position, the interior volumes of the retainer 104, ball-and-seat valve 106, and ball cage 108 are all in fluid communication with each other.

Figure 2:
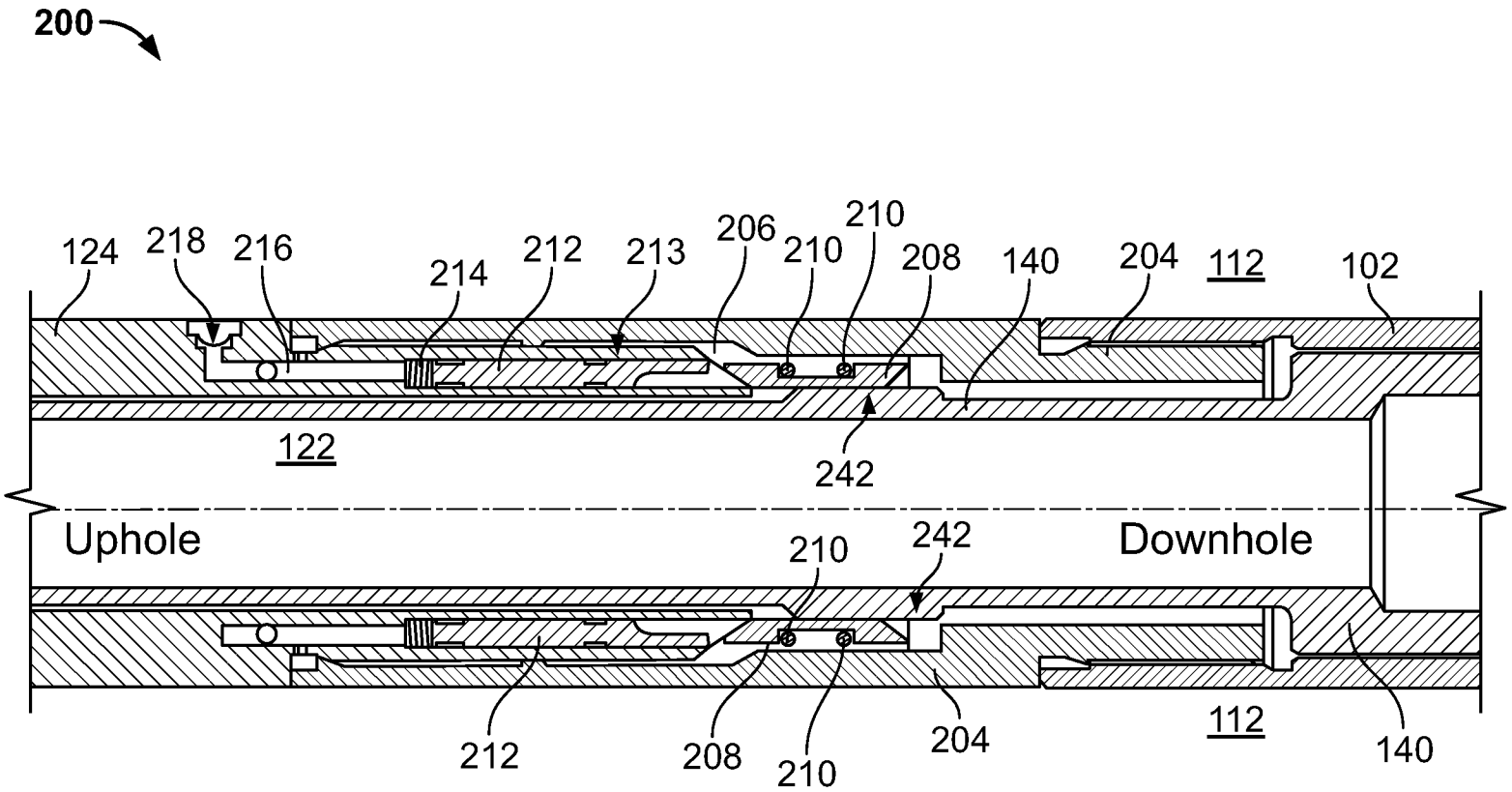
FIG. 2 illustrates a cross-section view of an example implementation of a valve actuator for a downhole valve system.

FIG. 2 illustrates a cross-section view of another example embodiment of a valve actuator 200 for downhole valve system 100. FIG. 2 illustrates the valve actuator 200 in the closed configuration. The valve actuator 200 includes a mandrel 140 that is configured to translate in response to applied annulus 112 pressure. The valve actuator 200 also includes a pressure chamber (not shown) enclosing a pressurized fluid at the particular pressure. The pressurized fluid can be a fluid such as air, nitrogen, or another fluid.

The mandrel 140 in the downhole valve actuator 200 is adjustable to a first position to close the downhole valve 106 based on a particular pressure in a pressure chamber greater than an annulus 112 pressure at a first pressure in the annulus 112. The first pressure in the annulus 112 can be at or greater than a hydrostatic pressure of the fluid in the wellbore at a depth of the downhole valve system 100. The difference between the annulus 112 pressure and the particular pressure in the pressure chamber can impart a net force on the mandrel 140, shifting the mandrel 140 uphole or downhole. In the closed configuration, the mandrel 140 is positioned relatively uphole (as shown); in the open configuration, the mandrel 140 is positioned relatively downhole.

The valve actuator 200 includes a housing 124, a tubular section 204, and the operating case 102. The mandrel 140, housing 124, and tubular section 204 define a fluid chamber 206. The fluid chamber 206 is fluidly connected to the annulus 112 but fluidly isolated from the bore 122. The mandrel 140 includes a shoulder 242 that protrudes radially outward into the fluid chamber 206.

The example valve actuator 200 also includes multiple segmented locking dogs 208 located within the fluid chamber 206. The dogs 208 are members positioned radially around the mandrel 140. The dogs 208 are held by one or more garter springs 210 that encircle the dogs 208. The garter springs 210 bias the dogs 208 radially inward. For example, in the closed configuration shown in FIG. 2, the dogs 208 are biased inward and impinge on the shoulder 242.

A spring-actuated piston 212 is located within a recess 213 defined by the housing 124. One end of the recess 213 is open to the fluid chamber 206. The end of the spring-actuated piston 212 distal the fluid chamber 206 is coupled to a spring 214. The spring 214 imparts a force that biases the spring-actuated piston 212 toward the fluid chamber 206. The housing 124 also defines an air chamber 216. The air chamber 216 is fluidly isolated from the annulus 112, the fluid chamber 206, and the bore 122. The air chamber 216 can be filled with a fluid such as air, nitrogen, or another fluid. A portion of the air chamber 216 is defined by the spring-actuated piston 212. The volume of fluid in the air chamber 216 is isolated, and the force from spring 214 is insufficient to shift the spring-actuated piston 212 out of the recess 213.

Thus, the spring-actuated piston 212 is maintained within the recess 213. The air chamber 216 is isolated from the annulus 112 by a rupture disk 218. The rupture disk 218 is a breakable member that can be ruptured by sufficiently high annulus 112 pressure, creating a fluid connection between the air chamber 216 and the annulus 112.

By increasing the annulus 112 pressure sufficiently, the pressure in the fluid chamber 206 can overcome the pressure exerted by a separate downhole pressure chamber (not shown) and cause the mandrel 140 to shift downhole. Shifting the mandrel 140 downhole opens the valve 106. Once the mandrel 140 is fully shifted downhole, the shoulder 242 shifts from beneath the dogs 208. The garter springs 210 constrict the dogs 208 against a reduced diameter portion of the mandrel 140 next to the shoulder 242. The valve 106 can be locked open by increasing the annulus 112 pressure to rupture the rupture disk 218.

The annulus 112 pressure necessary to rupture the rupture disk 218 is a second pressure greater than the first pressure that was sufficient to open the valve 106. With the disk 218 ruptured, the air chamber 216 is fluidly coupled to the annulus 112 and the spring-actuated piston 212 is released. The force exerted by the spring 214 pushes a portion of the spring-actuated piston 212 into the fluid chamber 206 and at least partially covers the dogs 208.

With the spring-actuated piston 212 positioned between the dogs 208 and the tubular section 204, the dogs 208 are unable to move radially. The shoulder 242 of the mandrel 140 stops against the dogs 208 if the mandrel 140 attempts to translate in the uphole direction, and the valve 106 is prevented from closing. Thus, the mandrel 140 is locked against movement urged by the pressurized fluid in the pressure chamber and the downhole valve 106 is locked in an open position independent of the particular pressure being greater than the annulus 112 pressure.

Figure 3:
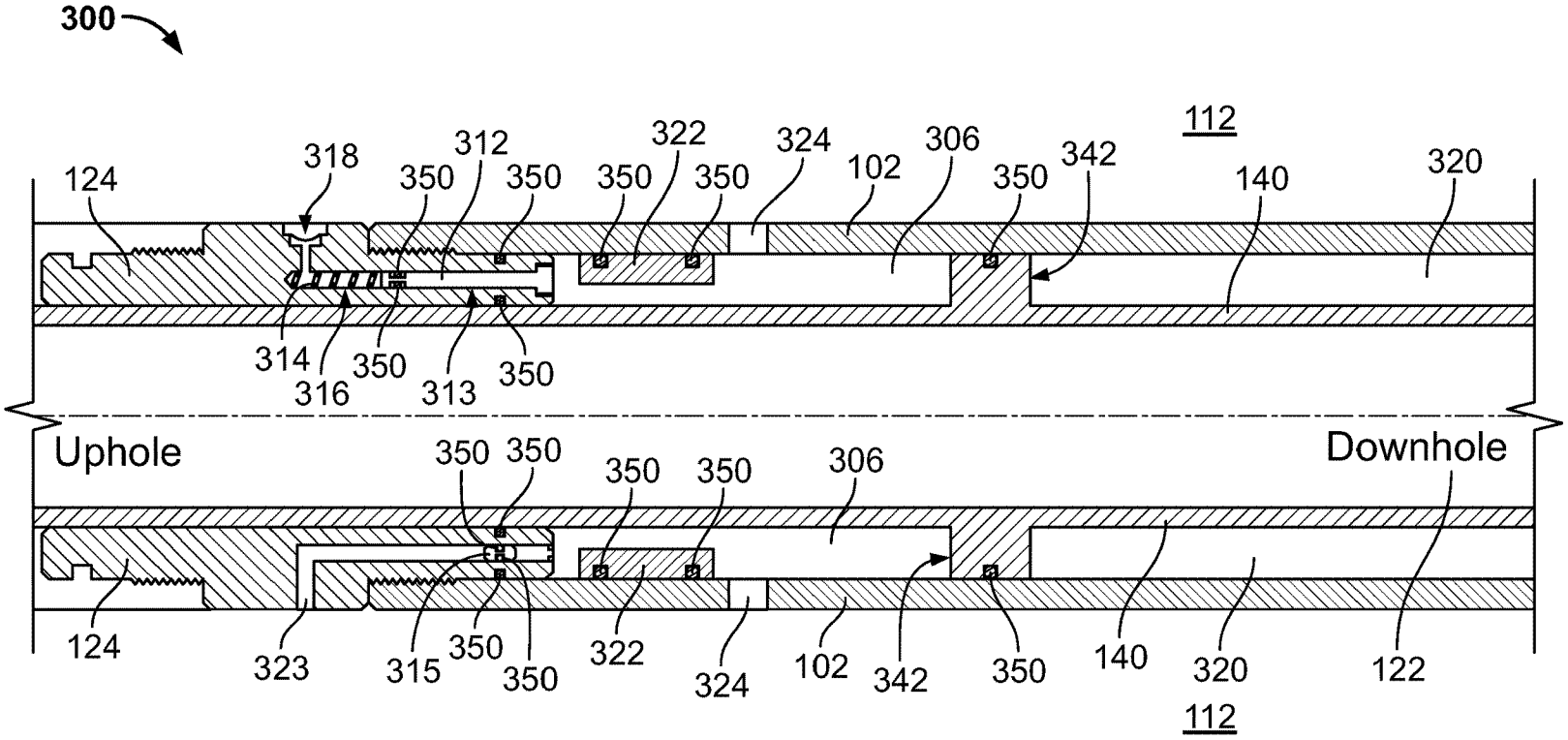
FIG. 3 illustrates a cross-section view of another example implementation of a valve actuator for a downhole valve system.

FIG. 3 illustrates a cross-section view of another example implementation 300 of valve actuator 150 for downhole valve system 100. FIG. 3 illustrates the valve actuator 300 in the closed configuration. The valve actuator 300 includes a housing 124 and an operating case 102. The valve actuator 300 includes a mandrel 140 that is able to translate in response to applied annulus 112 pressure. In the closed configuration, the mandrel 140 is positioned relatively uphole (as shown); in the open configuration, the mandrel 140 is positioned relatively downhole. The mandrel 140 includes a shoulder 342 that extends radially outward to the operating case 102.

The mandrel 140, shoulder 342, and operating case 102 define a pressure chamber 320 enclosing a pressurized fluid at a particular pressure. The pressurized fluid can be a fluid such as air, nitrogen, or another fluid. The mandrel 140, shoulder 342, housing 124, and operating case 102 define a fluid chamber 306 that is positioned adjacent a portion of the mandrel 140 that is adjacent the pressure chamber 320. One or more seals 350 between the shoulder 342 and the operating case 102 fluidly isolate the pressure chamber 320 from the fluid chamber 306. The fluid chamber 306 is fluidly connected to the annulus 112 via one or more ports 324 in the operating case 102, but the fluid chamber 306 is fluidly isolated from the bore 122.

A spring-actuated piston 312 is located within a recess 313 defined by the housing 124. One end of the recess 313 is open to the fluid chamber 306. The end of the spring-actuated piston 312 distal from the fluid chamber 306 is coupled to a spring 314. The spring 314 imparts a force that biases the spring-actuated piston 312 toward the fluid chamber 306. The housing 124 also defines an air chamber 316. The air chamber 316 is fluidly isolated from the annulus 112, the fluid chamber 306, and the bore 122. The air chamber 316 can be filled with a fluid such as air, nitrogen, or another fluid.

A portion of the air chamber 316 is defined by the spring-actuated piston 312. The isolated volume of gas in the air chamber 316 overcomes the force from spring 314 and the spring-actuated piston 312 is maintained within the recess 313. The air chamber 316 is isolated from the annulus 112 by a rupture disk 318. The rupture disk 318 is a breakable member that can be ruptured by sufficiently high annulus 112 pressure, creating a fluid connection between the air chamber 316 and the annulus 112. The valve actuator 300 also includes a sleeve 322. The sleeve 322 is located within fluid chamber 306 and positioned between the spring-actuated piston 312 and the ports 324.

The housing 124 also defines a passage 323. One end of the passage 323 is open to the fluid chamber 306, and the other end of the passage 323 is open to the annulus 112. A volume displacement piston 315 is located within the passage 323. One or more seals 350 on the volume displacement piston 315 fluidly isolate the fluid chamber 306 end of the passage 323 from the annulus 112 end of the passage 323.

The valve 106 is opened by increasing the annulus 112 pressure to a first pressure. If the annulus 112 pressure is sufficiently high, the pressure in the fluid chamber 306 overcomes the pressure in the pressure chamber 320. The net force due to the pressure difference shifts the mandrel 140 downhole and thus open the valve 106. The valve 106 is locked in the open position by increasing the annulus 112 pressure to a second pressure to rupture the rupture disk 318. The second pressure to rupture the rupture disk 318 is greater than the first pressure to open the valve 106.

With the disk 318 ruptured, the air chamber 316 is fluidly coupled to the annulus 112 and the spring-actuated piston 312 is released. The force exerted by the spring 314 pushes a portion of the spring-actuated piston 312 into the fluid chamber 306. The spring-actuated piston 312 impinges on the sleeve 322 and urges it downhole, covering the ports 324. The sleeve 322 includes one or more seals 350 that fluidly isolate the fluid chamber 306 from the annulus 112 when the sleeve 322 covers the ports 324. The fluid chamber 306 traps the fluid within at the annulus 112 pressure to lock the mandrel 140 against movement urged by the pressurized fluid in the pressure chamber 320. As such, the valve 106 is locked in the open position independent of the particular pressure in the pressure chamber 320 being greater than the annulus 112 pressure.

Once the sleeve 322 covers the ports 324 sufficiently to isolate the fluid chamber 306, the volume displacement piston 315 can shift within the passage 323 to increase the effective volume of the fluid chamber 306 and allow the spring-actuated piston 312 to fully extend. Thus, the valve 106 is fully locked in the open position.

Figure 4:
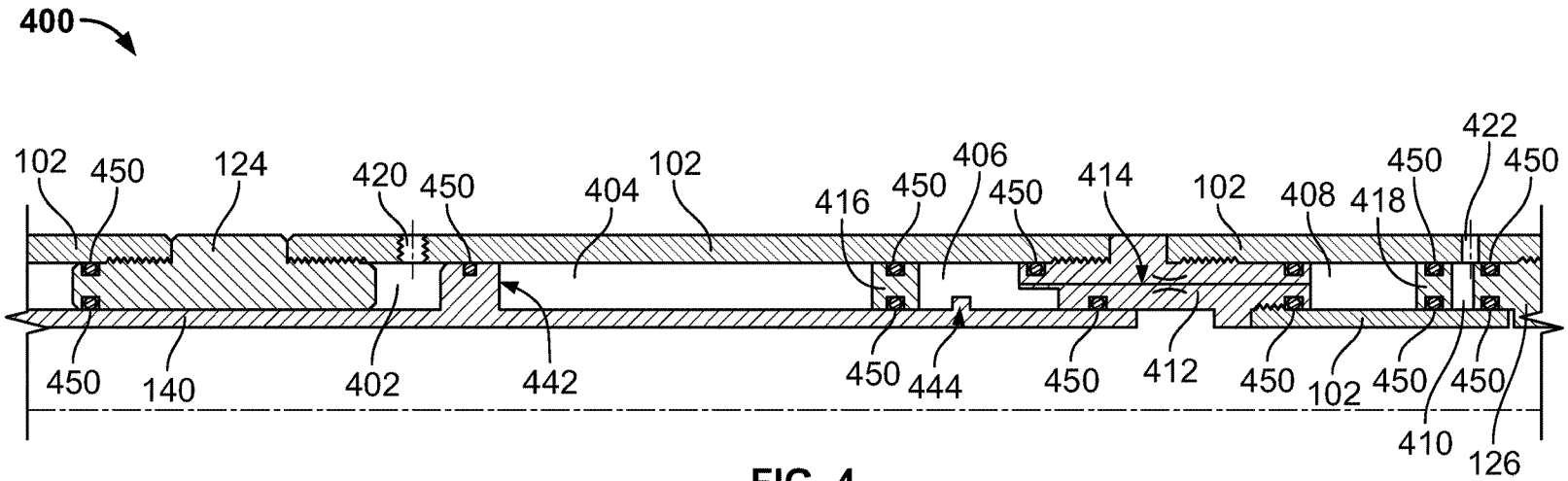
FIG. 4 illustrates a cross-section view of another example implementation of a valve actuator for a downhole valve system.

FIG. 4 illustrates a cross-section view of another example implementation 400 of valve actuator 150 for downhole valve system 100. FIG. 4 illustrates the valve actuator 400 in the closed configuration. The valve actuator 400 includes upper housing 124, lower housing 126, and operating cases 102. The valve actuator 400 includes a mandrel 140 that is able to translate in response to applied annulus 112 pressure. In the closed configuration, the mandrel 140 is positioned relatively uphole (as shown); in the open configuration, the mandrel 140 is positioned relatively downhole. The mandrel 140 includes a shoulder 442 and an impinging shoulder 444 that extend radially outward.

The valve actuator 400 includes an upper fluid chamber 402 defined by the upper housing 124, operating case 102, and the shoulder 442 of mandrel 140. The upper fluid chamber 402 is fluidly connected to the annulus 112 via one or more upper ports 420 in the operating case 102. The valve actuator 400 includes an upper piston 416 that is located radially between the mandrel 140 and the operating case 102 and axially between the shoulder 442 and the impinging shoulder 444. A pressure chamber 404 is defined by the shoulder 442, the mandrel 140, the operating case 102, and the upper piston 416. The pressure chamber 404 can contain nitrogen or air or another gas or fluid.

The valve actuator 400 also includes a tubular section 412 that is located between the impinging shoulder 444 and the lower housing 126. An upper oil chamber 406 is defined by the upper piston 416, the mandrel 140, the operating case 102, and the tubular section 412. The upper oil chamber 406 can contain oil or another gas or fluid. The upper piston 416 includes one or more seals 450 to fluidly isolate the pressure chamber 404 from the upper oil chamber 406. A lower piston 418 is located between the tubular section 412 and the lower housing 126. A lower oil chamber 408 is defined by the tubular section 412, the operating case 102, and the lower piston 418. The tubular section 412 includes a passage 414 that fluidly connects the upper oil chamber 406 to the lower oil chamber 408. The passage 414 can be a small orifice or can include a metering device such that fluid transfer between the upper oil chamber 406 and the lower oil chamber 408 is a relatively slow process.

The valve actuator 400 also includes a lower fluid chamber 410 defined by the lower housing 126, the operating case 102, and the lower piston 418. The lower fluid chamber 410 is fluidly connected to the annulus 112 via one or more lower ports 422 in the operating case 102. Regions can be fluidly isolated by seals 450 as shown in FIG. 4.

The valve 106 is opened by sufficiently increasing the pressure within the annulus 112. Increasing the annulus 112 pressure increases the pressure within the fluidly connected upper fluid chamber 402. When the pressure within the upper fluid chamber 402 is high enough to overcome the pressure in the pressure chamber 404, the net force shifts the mandrel 140 downhole and opens the valve 106. The increased pressure in the annulus 112 also increases the pressure in the fluidly connected lower fluid chamber 410. The increased pressure in the lower fluid chamber 410 shifts the lower piston 418 uphole and compresses the oil in lower oil chamber 408. The compressed oil in lower oil chamber 408 transfers slowly through passage 414 into upper oil chamber 406. As the oil pressure in upper oil chamber 406 increases, the upper piston 416 shifts uphole.

When the annulus 112 pressure is decreased, as when the tool is removed from the well, the pressure in the pressure chamber 404 imparts a force on the shoulder 442 and the upper piston 416. The pressure in the pressure chamber 404 shifts the upper piston 416 downhole until it impinges on shoulder 444. The pressure in the pressure chamber 404 thus imparts an uphole force and a downhole force equally on the mandrel 140, preventing the mandrel 140 from shifting. Thus, the valve 106 remains in the open position.

Figure 5:
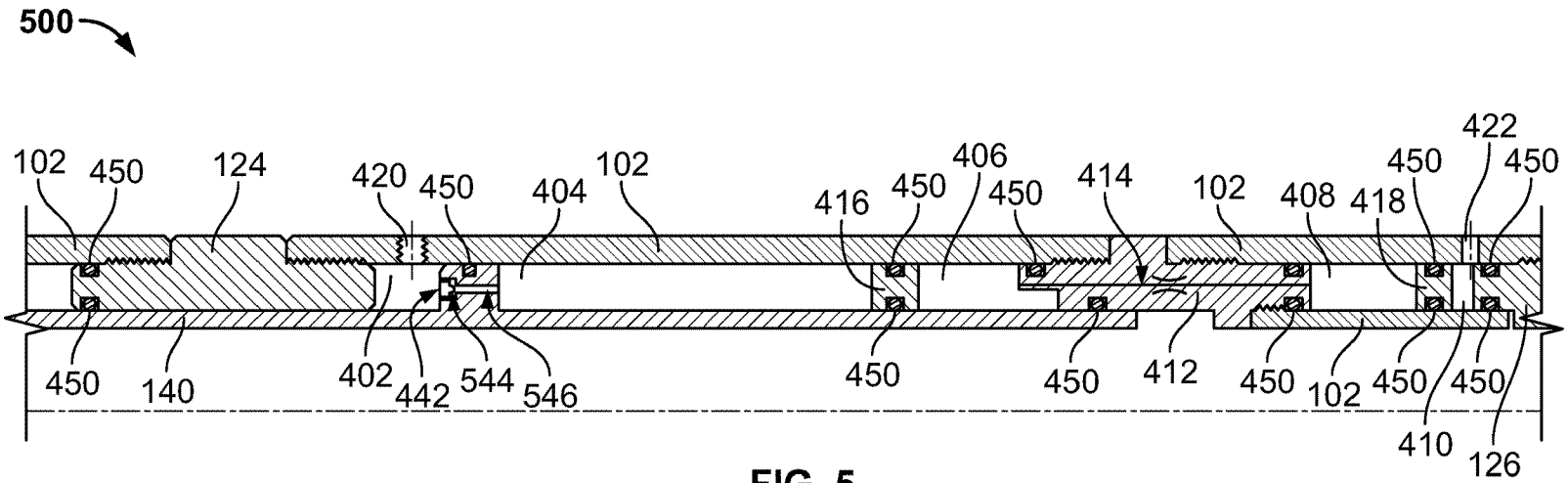
FIG. 5 illustrates a cross-section view of another example implementation of a valve actuator for a downhole valve system.

FIG. 5 illustrates a cross-section view of another example implementation 500 of valve actuator 150 for downhole valve system 100. FIG. 5 illustrates the valve actuator 500 in the closed configuration. The example valve actuator 500 is substantially similar to the example valve actuator 400 shown in FIG. 4. The valve actuator 500 does not include an impinging shoulder 444. The valve actuator 500 does include a fluid conduit 546 within the shoulder 442. One end of the conduit 546 is open to the upper fluid chamber 402 and one end of the conduit 546 is open to the pressure chamber 404. The upper fluid chamber 402 is fluidly coupled to the annulus 112, thus the conduit 546 fluidly couples the pressure chamber 404 and the exterior surface of the downhole valve system 100. A rupture disk 544 is a breakable member positioned within the conduit 546 between the pressure chamber 404 and the upper fluid chamber 402 such that the upper fluid chamber 402 is isolated from the pressure chamber 404.

Similarly to valve actuator 400, increasing the annulus 112 pressure opens the valve 106 by shifting the mandrel 140. To lock the valve 106 in the open position, the annulus 112 pressure is increased to rupture the rupture disk 544. Rupturing the rupture disk 544 fluidly connects the pressure chamber 404 and the upper fluid chamber 402, and thus the pressurized fluid in the pressure chamber 404 bleeds into the upper fluid chamber 402. This renders the mandrel 140 lockable against movement, and thus the valve 106 is locked in the open position irrespective of annulus 112 pressure. In some implementations, the rupture disk 544 is a supported rupture disk that can only be ruptured by high pressure in the annulus 112 relative to the pressure in the pressure chamber 404.

Figure 6:
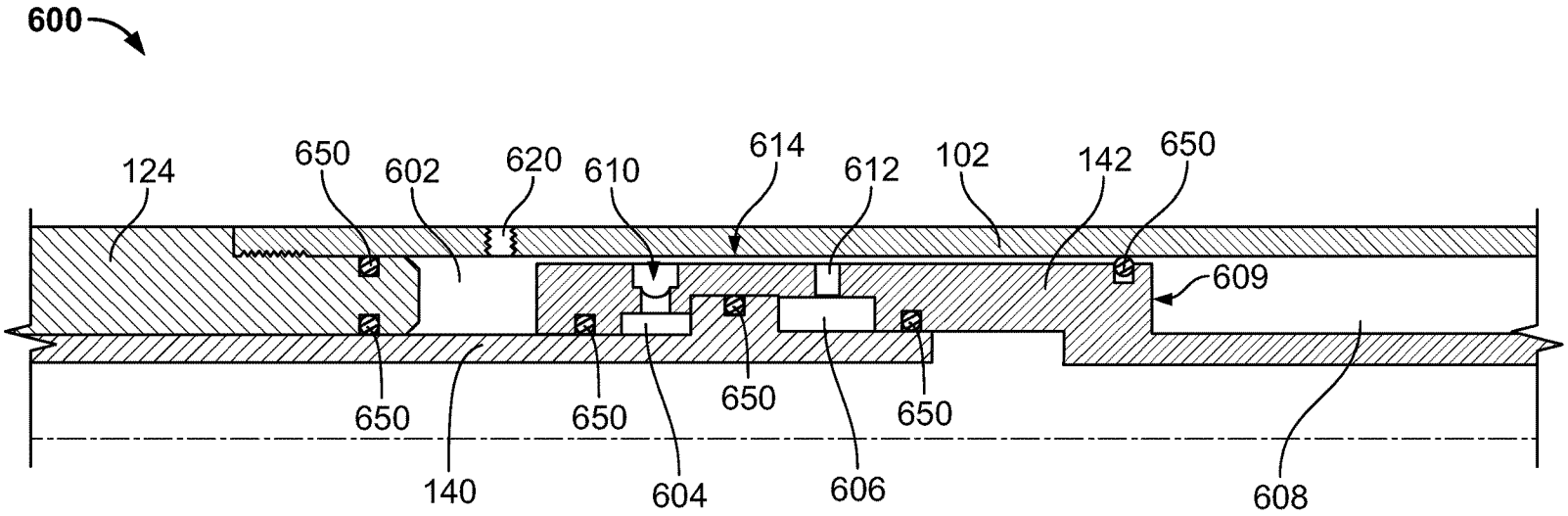
FIG. 6 illustrates a cross-section view of another example implementation of a valve actuator for a downhole valve system.

FIG. 6 illustrates a cross-section view of another example implementation 600 of valve actuator 150 for downhole valve system 100. FIG. 6 illustrates the valve actuator 600 in the closed configuration. The valve actuator 600 includes upper housing 124 and operating case 102. The valve actuator 600 also includes an upper mandrel 140 and a lower mandrel 142 radially adjacent the upper mandrel 140. The upper mandrel 140 is coupled to the valve 106. The lower mandrel 142 is able to translate in response to applied annulus 112 pressure. Components of valve actuator 600 can be fluidly isolated by one or more seals 650.

The valve actuator 600 includes an upper fluid chamber 602 defined by the housing 124, the operating case 102, the upper mandrel 140, and the lower mandrel 142. The upper fluid chamber 602 is fluidly connected to the annulus 112 by port 620. A passage 614 is defined by the operating case 102 and the lower mandrel 142. One end of the passage 614 is fluidly connected to the upper fluid chamber 602.

The valve actuator 600 includes a lower fluid chamber 606 defined by the upper mandrel 140 and the lower mandrel 142. The lower fluid chamber 606 is fluidly connected to passage 614 via port 612. The valve actuator 600 also includes an air chamber 604 defined by the upper mandrel 140 and the lower mandrel 142. The air chamber 604 can be filled with a fluid such as air, nitrogen, or another fluid. The air chamber 604 is fluidly isolated from the passage 614 by rupture disk 610. The air chamber 604 couples the upper mandrel 140 to the lower mandrel 142 such that the mandrels 140, 142 translate together as a single component. The valve actuator 600 also includes a pressure chamber 608 partially defined by the lower mandrel 142 and the operating case 102. The lower mandrel 142 includes an effective surface 609 adjacent the pressure chamber 608. The pressure chamber 608 can be filled with nitrogen or another gas or fluid.

In the closed configuration, the upper mandrel 140 and the lower mandrel 142 are positioned relatively uphole (as shown); in the open configuration, the upper mandrel 140 is positioned relatively downhole. When the upper mandrel 140 is coupled to the lower mandrel 142, both mandrels 140, 142 are positioned relatively downhole when in the open configuration. The valve 106 is opened by increasing the pressure within the annulus 112 to a first pressure greater than the particular pressure within the pressure chamber 608. Increasing the annulus 112 pressure increases the pressure within the upper fluid chamber 602. The pressure within the upper fluid chamber 602 overcomes the particular pressure in the pressure chamber 608, and the net force shifts the lower mandrel 142 downhole. The upper mandrel 140 is coupled to the lower mandrel 142, and shifting the upper mandrel 140 downhole opens the valve 106.

To lock the valve 106 in the open position, the annulus 112 pressure is increased to a second pressure to rupture the rupture disk 610. Rupturing the rupture disk 610 fluidly connects the air chamber 604 and the passage 614, and thus the air in the air chamber 604 vents into the upper fluid chamber 602 and the air chamber 604 is filled with annulus fluid. This decouples the upper mandrel 140 from the lower mandrel 142. The pressurized fluid in the pressure chamber 608 acts on the effective surface 609 of the lower mandrel 142 independent of the upper mandrel 140 to maintain the upper mandrel 140 at an open position, locking the downhole valve 106 in the open position. In some implementations, the rupture disk 610 is a supported rupture disk that can only be ruptured by high pressure in the annulus 112 relative to the pressure in the air chamber 604.

Figure 7:
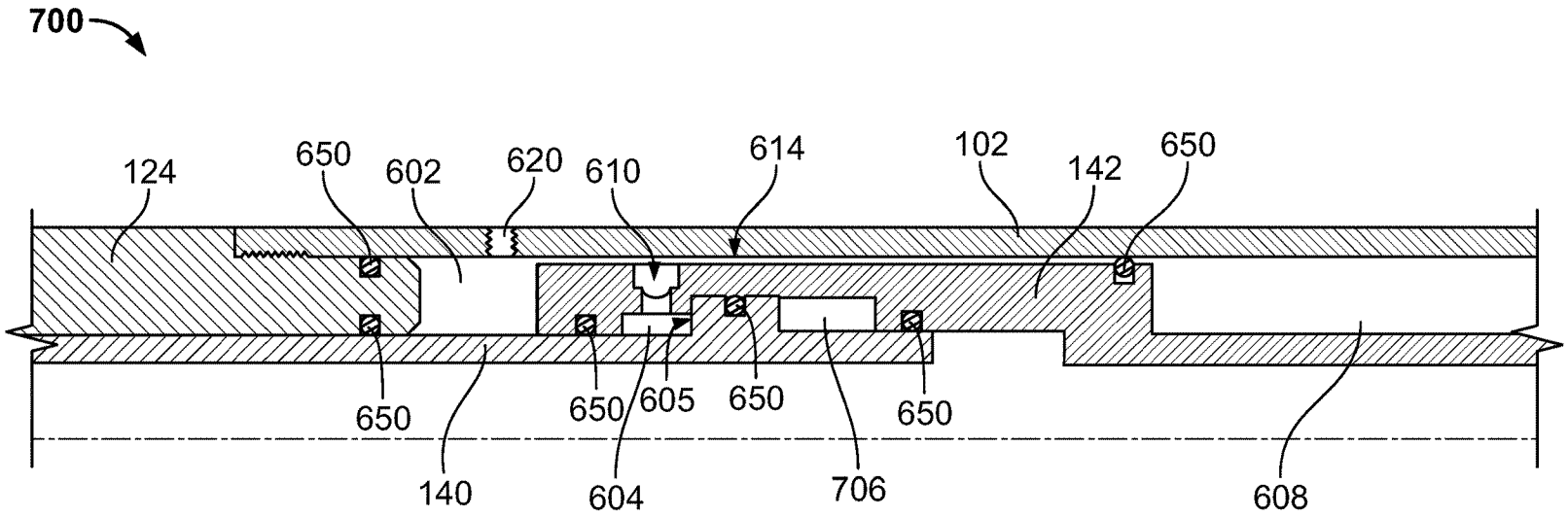
FIG. 7 illustrates a cross-section view of another example implementation of a valve actuator for a downhole valve system.

FIG. 7 illustrates a cross-section view of another example implementation 700 of valve actuator 150 for downhole valve system 100. FIG. 7 illustrates the valve actuator 700 in the closed configuration. The example valve actuator 700 is substantially similar to the example valve actuator 600 shown in FIG. 6. The valve actuator 700 does not include a port 612 or a lower fluid chamber 606. Valve actuator 700 does include a lower air chamber 706 positioned radially between the upper mandrel 140 and lower mandrel 142. The lower air chamber 706 can be filled with a gas or fluid such as air, nitrogen, or another substance.

The upper air chamber 604 and the lower air chamber 706 couple the upper mandrel 140 to the lower mandrel 142 such that the mandrels 140, 142 translate together as a single component. The valve 106 can be opened and closed via annulus 112 pressure as described above for FIG. 6.

The valve 106 is locked in the open position by increasing the annulus 112 pressure sufficiently to rupture the rupture disk 610. Rupturing the rupture disk 610 fluidly connects the upper air chamber 604 to the fluid chamber 602, bringing the pressure within the upper air chamber 604 to annulus 112 pressure. In some implementations, the volume of upper air chamber 604 is larger than the volume of lower air chamber 706. Thus, the annulus 112 pressure in the upper air chamber 604 overcomes the pressure in lower air chamber 706 and imparts a force on the effective surface 605 of the upper mandrel 140, compressing the volume of air in lower air chamber 706. This urges upper mandrel 140 to lower mandrel 142 while still maintaining the coupling between mandrels 140, 142. Because the upper mandrel 140 is coupled to lower mandrel 142 but positioned relatively downhole, the upper mandrel 140 is unable to shift sufficiently uphole to close the valve 106 even if both mandrels 140, 142 are shifted uphole due to decreased annulus 112 pressure.

Figure 8:
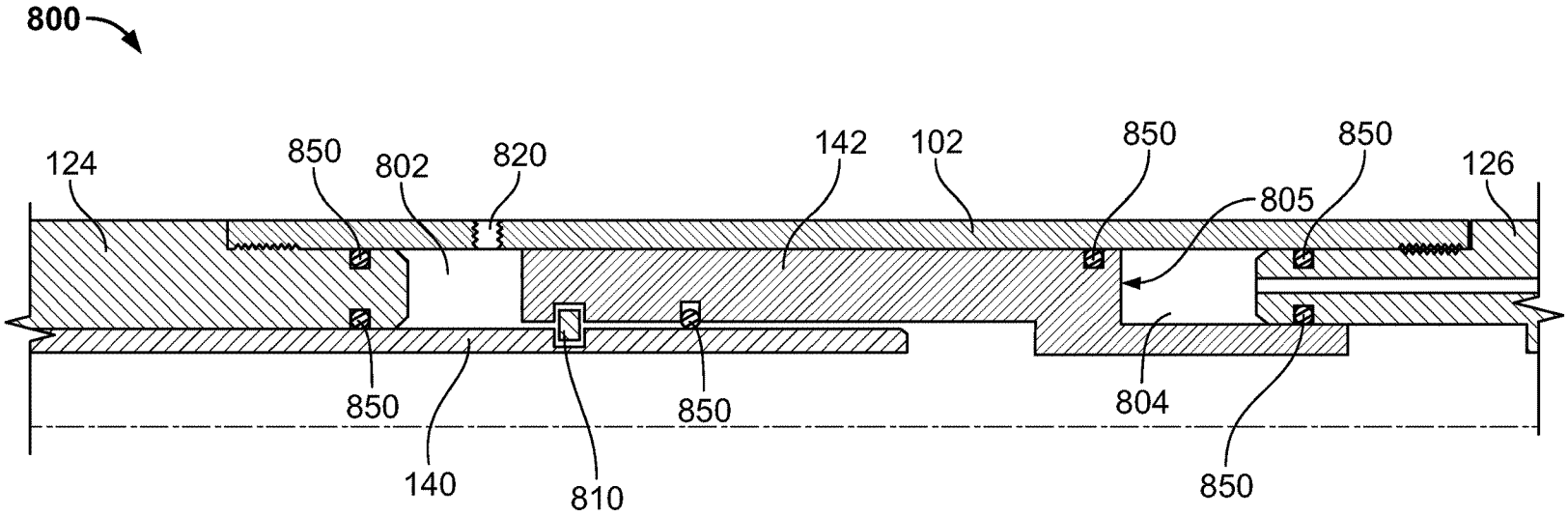
FIG. 8 illustrates a cross-section view of another example implementation of a valve actuator for a downhole valve system.

FIG. 8 illustrates a cross-section view of another example implementation 800 of valve actuator 150 for downhole valve system 100. FIG. 8 illustrates the valve actuator 800 in the closed configuration. The valve actuator 800 includes upper housing 124 and operating case 102. The valve actuator 800 also includes an upper mandrel 140 and a lower mandrel 142. The upper mandrel 140 is coupled to the valve 106. The lower mandrel 142 is able to translate in response to applied annulus 112 pressure. The upper mandrel 140 is coupled to the lower mandrel 142 by a shear pin 810 such that the mandrels 140, 142 translate together as a single component. The valve actuator 800 includes a fluid chamber 802 defined by the housing 124, the operating case 102, the upper mandrel 140, and the lower mandrel 142. The upper fluid chamber 802 is fluidly connected to the annulus 112 by port 820. Components of valve actuator 800 can be fluidly isolated by one or more seals 850.

The valve 106 is opened by increasing the annulus 112 pressure. If the annulus 112 pressure is sufficiently high, the pressure in the fluid chamber 802 overcomes the pressure in the pressure chamber 804. The net force due to the pressure difference shifts the mandrels 140, 142 downhole and thus opens the valve 106. The valve 106 is locked open by applying a sufficiently high annulus 112 pressure to shear the shear pin 810. The downhole transit of upper mandrel 140 is limited by its coupling to the valve 106 or by another mechanism (e.g. an impinging shoulder). Once the downhole transit limit of upper mandrel 140 is reached, increasing the annulus 112 pressure sufficiently high imparts enough force on the lower mandrel 142 to shear the pin 810. Breaking the shear pin 810 uncouples the lower mandrel 142 from the upper mandrel 140. The pressurized fluid in the pressure chamber 804 acts on the effective surface 805 of the lower mandrel 142 independent of the upper mandrel 140 to maintain the upper mandrel 140 at an open position, locking the downhole valve 106 in the open position.

Figure 9:
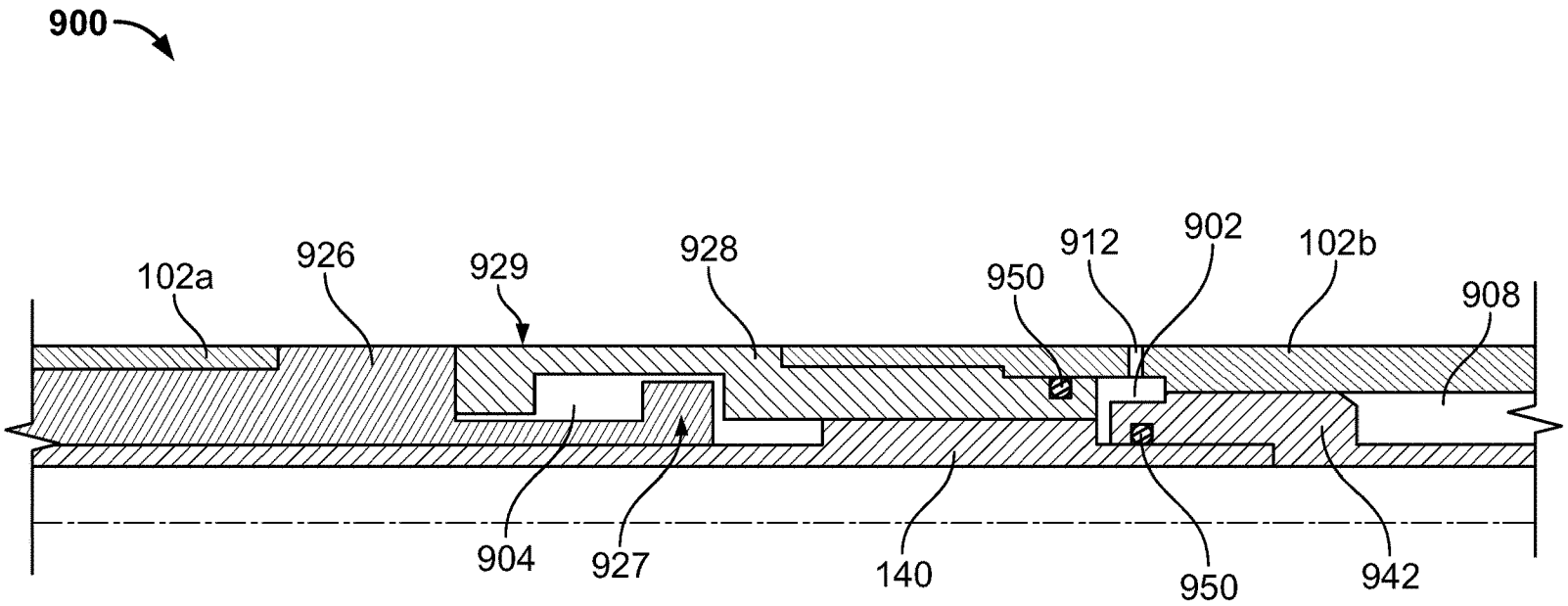
FIG. 9 illustrates a cross-section view of another example implementation of a valve actuator for a downhole valve system.

FIG. 9 illustrates a portion of another example implementation 900 of valve actuator 150 for downhole valve system 100. FIG. 9 illustrates the valve actuator 900 in the closed configuration. The valve actuator 900 includes an upper operating case 102*a* and a lower operating case 102*b*. The upper operating case 102*a* is affixed to an upper locking member 926. The upper locking member 926 includes an upper hook-shaped member 927 that extends downhole. The lower operating case 102*b* is affixed to a lower locking member 928. The lower locking member 928 includes a lower hook-shaped member 929 that complements the upper hook-shaped member 927. A chamber 904 is located between and defined by the upper hook-shaped member 927 and the lower hook-shaped member 929.

The valve actuator 900 also includes a mandrel 140 affixed to a piston 942. The mandrel 140 is coupled to the valve 106, and is able to translate in response to applied annulus 112 pressure. The mandrel 140 is affixed to the piston the mandrel 140 and piston 942 translate together as a single component. The valve actuator 900 includes a fluid chamber 902 defined by the lower locking member 928, the operating case 102*b*, the lower mandrel 140, and the piston 942. The upper fluid chamber 902 is fluidly connected to the annulus 112 by port 912. Components of valve actuator 900 can be fluidly isolated by one or more seals 950.

The valve actuator 900 also includes a pressure chamber 908 partially defined by the piston 942 and the lower operating case 102*b*. The pressure chamber 908 can be filled with nitrogen or another gas or fluid. The valve 106 is opened by sufficiently increasing the pressure within the annulus 112. Increasing the annulus 112 pressure increases the pressure within the fluid chamber 902. When the pressure within the upper fluid chamber 902 is high enough to overcome the pressure in the pressure chamber 908, the net force shifts the piston 142 downhole. The mandrel 140 is coupled to the piston 942, and shifting the mandrel 140 downhole relative to the upper operating case 102*a* opens the valve 106.

As the valve actuator 900 is removed from the well, tension in the string pulls apart the lower locking member 928 and the upper locking member 926. A downhole-facing surface of the upper hook-shaped member 929 stops against an uphole-facing surface of the lower hook-shaped member 927, closing the chamber 904. This extends the total length of the valve actuator 900, and increases the uphole travel distance required for mandrel 140 to shift in order to close the valve 106. The allowed uphole travel distance of the mandrel 140 or piston 942 can be limited by position of the uphole end of the fluid chamber 902, an impinging shoulder, or via another mechanism. As the annulus 112 pressure decreases during tool removal, the pressure in pressure chamber 908 shifts the piston 942 uphole. However, with the valve actuator 900 extended, the shift distance is insufficient to completely close the valve 106. Thus, the valve 106 remains open during tool removal.

In an example implementation, a method of adjusting a downhole valve includes positioning a downhole valve assembly in a wellbore. The downhole valve assembly includes a downhole valve coupled to a downhole valve actuator that includes a pressure chamber enclosing a pressurized fluid at a closing pressure. The downhole valve actuator maintains the valve in a closed position as long as the closing pressure is greater than an annulus pressure in an annulus between the downhole valve assembly and the wellbore. The method includes circulating a fluid in the annulus to set the annulus pressure at a first fluid pressure; based on the annulus pressure greater than the closing pressure of the pressurized fluid, activating the downhole valve actuator to adjust the valve to an open position from the closed position; circulating the fluid in the annulus to set the annulus pressure at a second fluid pressure greater than the first fluid pressure to break a breakable member of the downhole valve actuator; and upon breaking of the breakable member, locking the valve in the open position independent of the relative values of the closing pressure and the annulus pressure.

In a first aspect combinable with the general implementation, the first set pressure is at or greater than a hydrostatic pressure of the fluid in the wellbore at a depth of the downhole valve assembly.

In a second aspect combinable with any of the previous aspects, the pressurized fluid includes nitrogen.

In a third aspect combinable with any of the previous aspects, the breakable member includes a rupture disk of the downhole valve actuator. Locking the valve in the open position independent of the relative values of the closing pressure and the annulus pressure includes breaking the rupture disk to release a spring-actuated piston to at least partially cover dogs that ride on a reduced diameter portion of a mandrel of the downhole valve actuator; covering, at least partially the dogs by the piston to lock the mandrel against movement urged by the pressurized fluid in the pressure chamber; and locking the valve in the open position independent of the relative values of the closing pressure and the annulus pressure.

In a fourth aspect combinable with any of the previous aspects, the breakable member includes a rupture disk of the downhole valve actuator. Locking the valve in the open position independent of the relative values of the closing pressure and the annulus pressure includes breaking the rupture disk to release a spring-actuated piston to urge a sleeve to cover a port that fluidly connects the annulus and a chamber positioned adjacent a portion of a mandrel of the downhole valve actuator that is adjacent the pressure chamber; trapping the fluid at the annulus pressure set at the second fluid pressure in the chamber; and locking the valve in the open position independent of the relative values of the closing pressure and the annulus pressure.

In a fifth aspect combinable with any of the previous aspects, the breakable member includes a supportable rupture disk of the downhole valve actuator. Locking the valve in the open position independent of the relative values of the closing pressure and the annulus pressure includes breaking the supportable rupture disk to bleed the pressurized fluid from the pressure chamber into the annulus; reducing a pressure, with the bleeding, in the pressurized chamber from the closing pressure to less than the annulus pressure; and locking the valve in the open position based on the pressure in the pressurized chamber being less than the annulus pressure.

In a sixth aspect combinable with any of the previous aspects, the breakable member includes a rupture disk of the downhole valve actuator. Locking the valve in the open position independent of the relative values of the closing pressure and the annulus pressure includes breaking the rupture disk to fill a chamber with the fluid from the annulus, the chamber adjacent an effective surface of an upper mandrel of the downhole valve actuator, the upper mandrel radially adjacent a lower mandrel of the downhole valve actuator that includes an effective surface adjacent the pressurized chamber decoupling the upper mandrel from the lower mandrel such that the pressurized fluid acts on the effective surface of the lower mandrel independent of the upper mandrel; and maintaining the upper mandrel at a position to lock the downhole valve in the open position.

In a seventh aspect combinable with any of the previous aspects, the breakable member includes a rupture disk of the downhole valve actuator. Locking the valve in the open position independent of the relative values of the closing pressure and the annulus pressure includes breaking the rupture disk to fill a first chamber with the fluid from the annulus, the first chamber adjacent an effective surface of an upper mandrel of the downhole valve actuator, the upper mandrel radially adjacent a lower mandrel of the downhole valve actuator that includes an effective surface adjacent the pressurized chamber; and based on filling the first chamber with the fluid, urging the upper mandrel to a position to lock the downhole valve in the open position through a second chamber positioned between the upper and lower mandrels.

In an eighth aspect combinable with any of the previous aspects, the breakable member includes a shear pin of the downhole valve actuator. Locking the valve in the open position independent of the relative values of the closing pressure and the annulus pressure includes breaking the shear pin to decouple an upper mandrel of the downhole valve actuator from a lower mandrel of the downhole valve actuator such that the pressurized fluid acts on an effective surface of the lower mandrel independent of the upper mandrel; and maintaining the upper mandrel at a position to lock the downhole valve in the open position.

In a ninth aspect combinable with any of the previous aspects, the valve includes a downhole tester valve.

In another example implementation, a downhole valve system includes a downhole valve positionable in a wellbore and a downhole valve actuator coupled to the downhole valve. An annulus is defined between the downhole valve and the wellbore. The downhole valve actuator includes a pressure chamber that encloses a pressurized fluid at a particular pressure and a breakable member, where the downhole valve actuator is adjustable to a first position to close the downhole valve when the particular pressure is greater than an annulus pressure at a first pressure in the annulus, and the downhole valve actuator is adjustable to a second position to lock the downhole valve in an open position independent of the relative values of the particular pressure and the annulus pressure, with the annulus pressure set at a second pressure greater than the first pressure to break the breakable member.

In a first aspect combinable with the general implementation, the first pressure is at or greater than a hydrostatic pressure of the fluid in the wellbore at a depth of the downhole valve system.

In a second aspect combinable with any of the previous aspects, the pressurized fluid includes nitrogen.

In a third aspect combinable with any of the previous aspects, the breakable member includes a rupture disk. The downhole valve actuator further includes a spring-actuated piston; and a mandrel. The spring-actuated piston is released upon breaking the rupture disk to at least partially cover dogs that ride on a reduced diameter portion of the mandrel. The mandrel is locked, when the dogs are covered, against movement urged by the pressurized fluid in the pressure chamber such that the valve is locked in the open position independent of the particular pressure being greater than the annulus pressure.

In a fourth aspect combinable with any of the previous aspects, the breakable member includes a rupture disk. The downhole valve actuator further includes a spring-actuated piston; a sleeve; and a mandrel. The spring-actuated piston is released upon breaking the rupture disk to urge the sleeve to cover a port that fluidly connects the annulus and a chamber positioned adjacent a portion of the mandrel that is adjacent the pressure chamber. The chamber is fillable to trap the fluid at the annulus pressure set at the second pressure to lock the mandrel against movement urged by the pressurized fluid in the pressure chamber such that the valve is locked in the open position independent of the relative values of the particular pressure and the annulus pressure.

In a fifth aspect combinable with any of the previous aspects, the breakable member includes a supportable rupture disk. The downhole valve actuator further includes a fluid conduit positioned to fluidly couple the pressure chamber and an exterior surface of the downhole valve system, the supportable rupture disk positioned in the fluid conduit between the pressure chamber and the exterior surface; and a mandrel locked against movement, when the valve actuator is in the second position, by breaking the supportable rupture disk to bleed the pressurized fluid from the pressure chamber, such that the valve is locked in the open position.

In a sixth aspect combinable with any of the previous aspects, the breakable member includes a rupture disk. The downhole valve actuator further includes a lower mandrel; an upper mandrel; and an air chamber adjacent an effective surface of the lower mandrel. The lower mandrel is radially adjacent the lower mandrel that includes an effective surface adjacent the pressurized chamber. The upper mandrel is uncoupled from the lower mandrel when the air chamber is filled with the annulus fluid based on breaking the rupture disk such that the pressurized fluid acts on the effective surface of the lower mandrel independent of the upper mandrel to maintain the upper mandrel at a position, when the downhole valve actuator is in the second position, to lock the downhole valve in the open position.

In a seventh aspect combinable with any of the previous aspects, the breakable member includes a rupture disk. The downhole valve actuator further includes a lower mandrel; an upper mandrel; a first air chamber adjacent an effective surface of the upper mandrel. The upper mandrel is radially adjacent the lower mandrel that includes an effective surface adjacent the pressurized chamber. A second air chamber is positioned radially between the upper and lower mandrels, the upper mandrel urged to the lower mandrel based on filling the first air chamber with the annulus fluid upon breaking the rupture disk such that the pressurized fluid acts on the effective surface of the lower mandrel independent of the upper mandrel to limit the upper mandrel to positions such that downhole valve actuator is not adjustable to the first position, to lock the downhole valve in the open position.

In an eighth aspect combinable with any of the previous aspects, the breakable member includes a shear pin. The downhole valve actuator further includes an upper mandrel; and a lower mandrel coupled to the upper mandrel with the shear pin. The upper mandrel is uncoupled from the lower mandrel based on breaking the shear pin such that the pressurized fluid acts on an effective surface of the lower mandrel independent of the upper mandrel to maintain the upper mandrel at a position, when the downhole valve actuator is in the second position, to lock the downhole valve in the open position.

In a ninth aspect combinable with any of the previous aspects, the valve includes a downhole tester valve.

A number of implementations have been described. Nevertheless, it will be understood that various modifications may be made. For example, example operations, methods, and/or processes described herein may include more steps or fewer steps than those described. Further, the steps in such example operations, methods, and/or processes may be performed in different successions than that described or illustrated in the figures. As another example, although certain implementations described herein may be applicable to tubular systems (e.g., drillpipe and/or coiled tubing), implementations may also utilize other systems, such as wireline, slickline, e-line, wired drillpipe, wired coiled tubing, and otherwise, as appropriate. For instance, some implementations may utilize a wireline system for certain communications and a casing tubular system for other communications, in combination with a fluid system. Accordingly, other implementations are within the scope of the following claims.

What is claimed is:

1. A method of adjusting a downhole valve, comprising:

positioning a downhole valve assembly in a wellbore, the downhole valve assembly comprising a downhole valve coupled to a downhole valve actuator that comprises a pressure chamber enclosing a pressurized fluid at a closing pressure, the downhole valve actuator maintaining the valve in a closed position as long as the closing pressure is greater than an annulus pressure in an annulus between the downhole valve assembly and the wellbore;

circulating a fluid in the annulus to set the annulus pressure at a first fluid pressure;

based on the annulus pressure greater than the closing pressure of the pressurized fluid, activating the downhole valve actuator to adjust the valve to an open position from the closed position;

circulating the fluid in the annulus to set the annulus pressure at a second fluid pressure greater than the first fluid pressure to break a rupture disk of the downhole valve actuator; and upon breaking of the rupture disk, locking the valve in the open position independent of the relative values of the closing pressure and the annulus pressure.

2. The method of claim 1, wherein the first set pressure is at or greater than a hydrostatic pressure of the fluid in the wellbore at a depth of the downhole valve assembly.

3. The method of claim 1, wherein the pressurized fluid comprises nitrogen.

4. The method of claim 1, wherein locking the valve in the open position independent of the relative values of the closing pressure and the annulus pressure comprises:

breaking the rupture disk to release a spring-actuated piston to at least partially cover dogs that ride on a reduced diameter portion of a mandrel of the downhole valve actuator;

covering, at least partially the dogs by the piston to lock the mandrel against movement urged by the pressurized fluid in the pressure chamber; and locking the valve in the open position independent of the relative values of the closing pressure and the annulus pressure.

5. The method of claim 1, wherein locking the valve in the open position independent of the relative values of the closing pressure and the annulus pressure comprises:

breaking the rupture disk to release a spring-actuated piston to urge a sleeve to cover a port that fluidly connects the annulus and a chamber positioned adjacent a portion of a mandrel of the downhole valve actuator that is adjacent the pressure chamber;

trapping the fluid at the annulus pressure set at the second fluid pressure in the chamber; and locking the valve in the open position independent of the relative values of the closing pressure and the annulus pressure.

6. The method of claim 1, wherein locking the valve in the open position independent of the relative values of the closing pressure and the annulus pressure comprises:

breaking the supportable rupture disk to bleed the pressurized fluid from the pressure chamber into the annulus;

reducing a pressure, with the bleeding, in the pressurized chamber from the closing pressure to less than the annulus pressure; and locking the valve in the open position based on the pressure in the pressurized chamber being less than the annulus pressure.

7. The method of claim 1, wherein locking the valve in the open position independent of the relative values of the closing pressure and the annulus pressure comprises:

breaking the rupture disk to fill a chamber with the fluid from the annulus, the chamber adjacent an effective surface of an upper mandrel of the downhole valve actuator, the upper mandrel radially adjacent a lower mandrel of the downhole valve actuator that comprises an effective surface adjacent the pressurized chamber;

decoupling the upper mandrel from the lower mandrel such that the pressurized fluid acts on the effective surface of the lower mandrel independent of the upper mandrel; and maintaining the upper mandrel at a position to lock the downhole valve in the open position.

8. The method of claim 1, wherein locking the valve in the open position independent of the relative values of the closing pressure and the annulus pressure comprises:

breaking the rupture disk to fill a first chamber with the fluid from the annulus, the first chamber adjacent an effective surface of an upper mandrel of the downhole valve actuator, the upper mandrel radially adjacent a lower mandrel of the downhole valve actuator that comprises an effective surface adjacent the pressurized chamber; and based on filling the first chamber with the fluid, urging the upper mandrel to a position to lock the downhole valve in the open position through a second chamber positioned between the upper and lower mandrels.

9. The method of claim 1, wherein the valve comprises a downhole tester valve.

10. A downhole valve system, comprising:

a downhole valve positionable in a wellbore, an annulus defined between the downhole valve and the wellbore; and a downhole valve actuator coupled to the downhole valve, the downhole valve actuator comprising a pressure chamber that encloses a pressurized fluid at a particular pressure and a rupture disk, where:

the downhole valve actuator is adjustable to a first position to close the downhole valve when the particular pressure is greater than an annulus pressure at a first pressure in the annulus, and the downhole valve actuator is adjustable to a second position to lock the downhole valve in an open position independent of the relative values of the particular pressure and the annulus pressure when the annulus pressure is set at a second pressure greater than the first pressure to break the rupture disk.

11. The downhole valve system of claim 10, wherein the first pressure is at or greater than a hydrostatic pressure of the fluid in the wellbore at a depth of the downhole valve system.

12. The downhole valve system of claim 10, wherein the pressurized fluid comprises nitrogen.

13. The downhole valve system of claim 10, wherein the downhole valve actuator further comprises:

a spring-actuated piston; and a mandrel, the spring-actuated piston released upon breaking the rupture disk to at least partially cover dogs that ride on a reduced diameter portion of the mandrel, the mandrel locked, when the dogs are covered, against movement urged by the pressurized fluid in the pressure chamber such that the valve is locked in the open position independent of the particular pressure being greater than the annulus pressure.

14. The downhole valve system of claim 10, wherein the downhole valve actuator further comprises:

a spring-actuated piston;

a sleeve; and a mandrel, the spring-actuated piston released upon breaking the rupture disk to urge the sleeve to cover a port that fluidly connects the annulus and a chamber positioned adjacent a portion of the mandrel that is adjacent the pressure chamber, where the chamber is fillable to trap the fluid at the annulus pressure set at the second pressure to lock the mandrel against movement urged by the pressurized fluid in the pressure chamber such that the valve is locked in the open position independent of the relative values of the particular pressure and the annulus pressure.

15. The downhole valve system of claim 10, wherein the downhole valve actuator further comprises:

a fluid conduit positioned to fluidly couple the pressure chamber and an exterior surface of the downhole valve system, the supportable rupture disk positioned in the fluid conduit between the pressure chamber and the exterior surface; and a mandrel locked against movement, when the valve actuator is in the second position, by breaking the supportable rupture disk to bleed the pressurized fluid from the pressure chamber, such that the valve is locked in the open position.

16. The downhole valve system of claim 10, wherein the the downhole valve actuator further comprises:

a lower mandrel;

an upper mandrel; and an air chamber adjacent an effective surface of the lower mandrel, the lower mandrel radially adjacent the lower mandrel that comprises an effective surface adjacent the pressurized chamber, where the upper mandrel is uncoupled from the lower mandrel when the air chamber is filled with the annulus fluid based on breaking the rupture disk such that the pressurized fluid acts on the effective surface of the lower mandrel independent of the upper mandrel to maintain the upper mandrel at a position, when the downhole valve actuator is in the second position, to lock the downhole valve in the open position.

17. The downhole valve system of claim 10, wherein downhole valve actuator further comprises:

a lower mandrel;

an upper mandrel;

a first air chamber adjacent an effective surface of the upper mandrel, the upper mandrel radially adjacent the lower mandrel that comprises an effective surface adjacent the pressurized chamber; and a second air chamber positioned radially between the upper and lower mandrels, the upper mandrel urged to the lower mandrel based on filling the first air chamber with the annulus fluid upon breaking the rupture disk such that the pressurized fluid acts on the effective surface of the lower mandrel independent of the upper mandrel to limit the upper mandrel to positions such that downhole valve actuator is not adjustable to the first position, to lock the downhole valve in the open position.

18. The downhole valve apparatus of claim 10, wherein the valve comprises a downhole tester valve.

* * * * *